US006604966B1

(12) United States Patent
Hayes et al.

(10) Patent No.: US 6,604,966 B1
(45) Date of Patent: Aug. 12, 2003

(54) FLEXIBLE CABLE ELECTRICAL CONNECTOR

(75) Inventors: Earl James Hayes, South Lyon, MI (US); Michael Jerome Alloway, Canton, MI (US); Raymond Bruce McLauchlan, Macomb Township, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/322,240

(22) Filed: Dec. 18, 2002

(51) Int. Cl.[7] ..... H01R 13/514

(52) U.S. Cl. ..... 439/752; 439/459; 439/596; 439/467; 439/492

(58) Field of Search ..... 439/460, 467, 439/456, 459, 595, 596, 492, 752

(56) References Cited

U.S. PATENT DOCUMENTS

| | | | | | |
|---|---|---|---|---|---|
| 4,693,539 | A | * | 9/1987 | Tighe, Jr. | 439/465 |
| 4,711,508 | A | | 12/1987 | Sueyoshi | 439/595 |
| 4,767,361 | A | | 8/1988 | Hoshino et al. | 439/596 |
| 4,907,990 | A | | 3/1990 | Bertho et al. | 439/851 |
| 5,044,972 | A | | 9/1991 | Ikeda | 439/268 |
| 5,647,775 | A | | 7/1997 | Polgar et al. | 439/752 |
| 5,779,506 | A | | 7/1998 | Okabe et al. | 439/752 |
| 6,024,605 | A | | 2/2000 | Beck, Jr. et al. | 439/595 |
| 6,116,954 | A | * | 9/2000 | Ries | 439/596 |
| 6,126,488 | A | | 10/2000 | Daoud | 439/676 |
| 6,305,981 | B1 | * | 10/2001 | Jetter et al. | 439/595 |
| 6,383,015 | B2 | * | 5/2002 | Mochizuki et al. | 439/492 |
| 6,428,345 | B2 | * | 8/2002 | Sawayanagi et al. | 439/456 |

* cited by examiner

*Primary Examiner*—Tho D. Ta
(74) *Attorney, Agent, or Firm*—Harrington & Smith LLP

(57) ABSTRACT

An electrical connector housing including a main body having a receiving area which is sized and shaped to receive a flat conductor cable with contacts attached thereto into the receiving area; and a locking section connected to the main body by a living hinge. The locking section comprising a front end and a rear end. When the locking section is inserted into a receiving aperture of the main body, the front end is adapted to block withdrawal of at least one of the contacts located in the receiving area and, the rear end includes at least one strain relief projection which is sized and shaped to press the flat conductor cable against the main body to form a strain relief for the cable.

17 Claims, 7 Drawing Sheets

FLEXIBLE CABLE ELECTRICAL CONNECTOR

BACKGROUND OF THE INVENTION

1. Field of the Invention

The present invention relates to electrical connectors and, more particularly, to an electrical connector and flat flexible cable assembly.

2. Brief Description of Prior Developments

U.S. Pat. No. 6,024,605 discloses an electrical connector with an interlocking living hinge. Electrical contacts which are post loaded onto flexible flat conductor cable (FFC) or flexible printed circuit cable (FPC) are known in the art.

In the automotive industry wiring frames with connector pockets or cavities for receiving electrical connector assemblies are used for the manufacturing of automotive wiring harnesses. During assembly, wires with terminals pre-attached to both ends, are routed, one at a time, from one connector to another in accordance with the wiring schematic. This method of assembly has proven to be low cost, effective in handling circuit complexity, and flexible in accommodating circuit changes without redesigning the harness.

As automobiles have gotten smaller and electrical/electronic content has increased, it has become more difficult to find space within the vehicle to route the increasingly larger wire harnesses. One method used to overcome this dilemma is to use flat flex cable (FFC) or flexible printed circuits (FPC) in place of discrete wires to save space and weight.

In the past, the accepted method to form an automotive wire harness using FFC or FPC was to use an automated mass termination system for attaching the terminals to the conductors and assembly the connector. However, such an automated mass terminations system requires a relatively large capital investment to purchase the automated assembly machinery. In addition, the automated systems have difficulty handling the more complex harnesses and circuit changes may be difficult, or impossible, to accommodate. The relative large capital investment and limited flexibility of the automated mass termination systems have limited its success in automotive applications. However, there is still a desire by automobile manufacturers to use FFC/FPC technology to manufacture wire harnesses in order to save weight and space.

There is a need for a wire harness which can be inserted into smaller areas of the automobile during the assembly line process, but which can be manufactured relatively easily for low-volume and high-volume quantities and without a relatively large capital investment of assembly machinery.

SUMMARY OF THE INVENTION

In accordance with one aspect of the present invention, an electrical connector housing is provided including a main body having a receiving area which is sized and shaped to receive a flat conductor cable with contacts attached thereto into the receiving area; and a locking section connected to the main body by a living hinge. The locking section comprising a front end and a rear end. When the locking section is inserted into a receiving aperture of the main body, the front end is adapted to block withdrawal of at least one of the contacts located in the receiving area and, the rear end includes at least one strain relief projection which is sized and shaped to press the flat conductor cable against the main body to form a strain relief for the cable.

In accordance with another embodiment of the present invention, an electrical connector assembly is provided comprising a flat conductor cable; electrical contacts attached to the cable; and a housing having the contacts and a portion of the cable located therein. The housing comprising a main body, a locking section and a living hinge connecting the locking section to the main body. The locking section is insertable into a receiving aperture in the main body with a front end of the locking section blocking withdrawal of the contacts from the housing and a rear end of the locking section clamping the flat conductor cable against the main body to form a strain relief for the cable.

In accordance with one method of the present invention, a method of assembling an electrical connector comprising steps of connecting electrical contacts to a flat conductor cable; inserting the contacts and a portion of the flat conductor cable into a main section of a connector housing; inserting a locking section of the connector housing into a receiving aperture of the main section, the connector housing comprising a living hinge which connects the locking section to the main section, wherein the step of inserting the locking section comprises bending the living hinge; and clamping a portion of the flat conductor cable between the main section and the locking section when the locking section is inserted into the connector housing to form a strain relief for the flat conductor cable.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figures 1, 2:
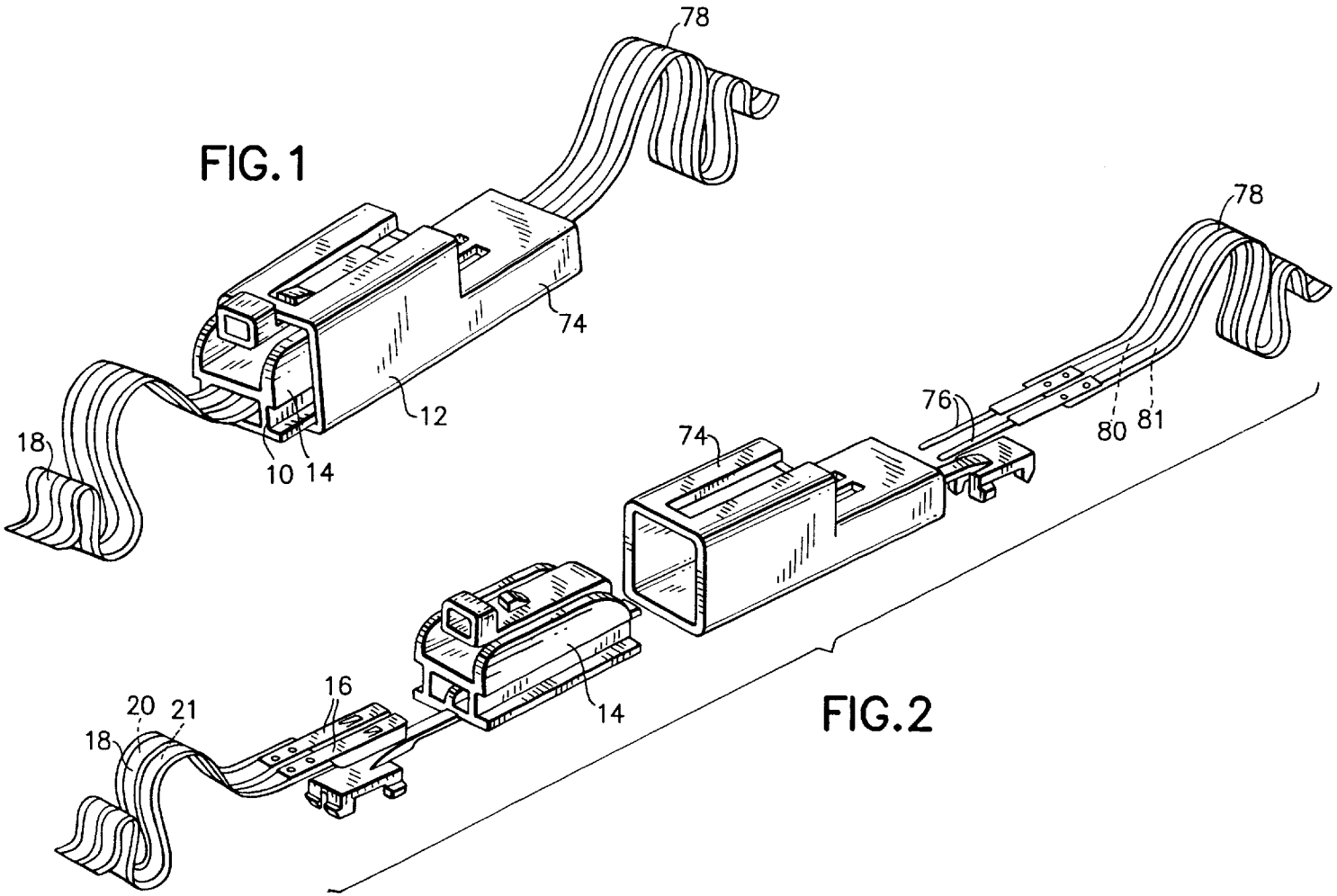
FIG. 1 is a perspective view of two electrical connector and cable assemblies incorporating features of the present invention shown connected to each other.
FIG. 2 is an exploded perspective view of the components of the assemblies shown in FIG. 1.

Referring to FIG. 1, there is shown a perspective view of two electrical connector and cable assemblies 10, 12 incorporating features of the present invention shown connected to each other. Although the present invention will be described with reference to the exemplary embodiments shown in the drawings, it should be understood that the present invention can be embodied in many alternate forms of embodiments. In addition, any suitable size, shape or type of elements or materials could be used.

Figure 3:
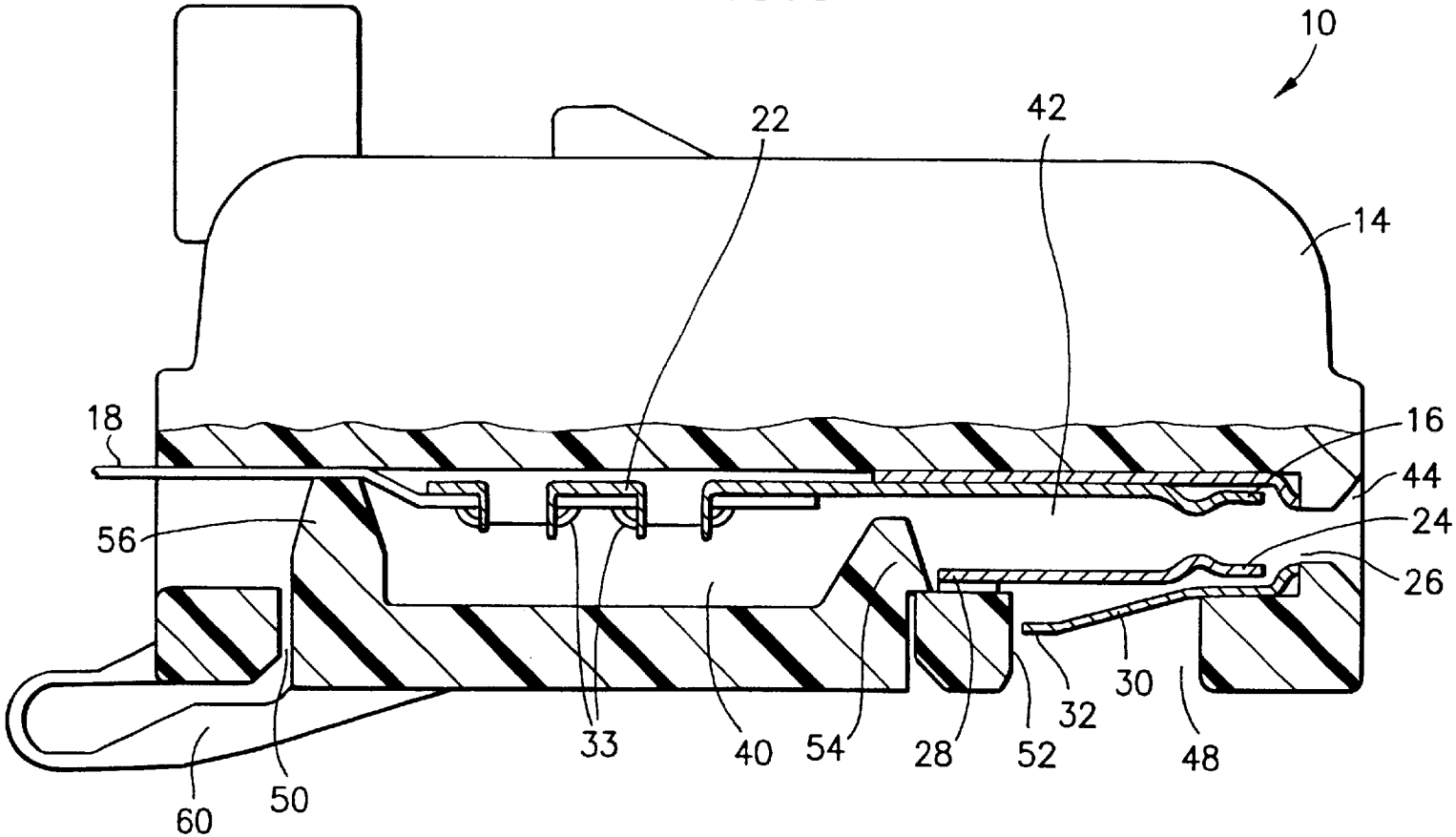
FIG. 3 is a cross sectional view of a first one of the electrical connector and cable assemblies shown in FIG. 1.

Referring also to FIGS. 2 and 3, the first electrical connector and cable assembly 10 generally comprises a connector housing 14, electrical contacts 16, and a conductor cable 18. The conductor cable 18 is a flex cable which generally comprises a flexible flat conductor cable or a flexible printed circuit cable. Flexible flat conductor cable and flexible printed circuit cable are well known in the art. In the embodiment shown, the conductor cable 18 comprises two electrical conductors 20, 21. However, in alternate embodiments, the conductor cable 18 could comprise more or less than two conductors. One end of the conductor cable 18 comprises the electrical contacts 16 individually connected thereto. More specifically, each electrical contact 16 is electrically connected to a respective one of the conductors 20, 21. The opposite end of the conductor cable 18 is attached to another component (not shown) such as an electrical or electronic component or another electrical connector.

The first assembly 10 comprises two of the electrical contacts 16. However, in alternate embodiments, the first assembly could comprise more or less than two electrical contacts. Each electrical contact 16 generally comprises a cable mounting section 22 and a mating contact section 24. The electrical contacts 16 are generally well known in the art. In alternate embodiments, any suitable type of electrical contact which is adapted to be mounted to a flat conductor cable could be provided.

The mating contact section 24 comprises a female contact section which is adapted to receive a male contact section of a mating electrical contact at a front end open aperture 26. The cable mounting section 22 extends from one side of the mating contact section 24 in a reward direction. An opposite side of the cable mounting section 22 comprises a stop surface 28. Also located on the opposite side, the mating contact section 24 comprises a primary terminal latch 30. The latch 30 is resiliently deflectable and comprises a rear end latch surface 32.

The cable mounting section 22 comprises two cable piercing sections 33. The piercing sections 33 are adapted to be inserted into and through the conductors 20 or 21 of the cable 18 and be outwardly deformed to form a fixed mechanical connection with the cable. This also forms an electrical connection between the contacts 16 and the conductors 20 or 21 in the cable 18. The cable mounting section 22 could also comprise lateral arms which wrap around portions of the cable around each conductor. This type of electrical connection is sometimes referred to as a post loaded connection wherein the terminals or contacts 16 are loaded onto the flex cable 18 before insertion into the housing 14. However, in alternate embodiments, any suitable type of connection between the contacts 16 and the cable 18 could be provided.

Figures 5, 6:
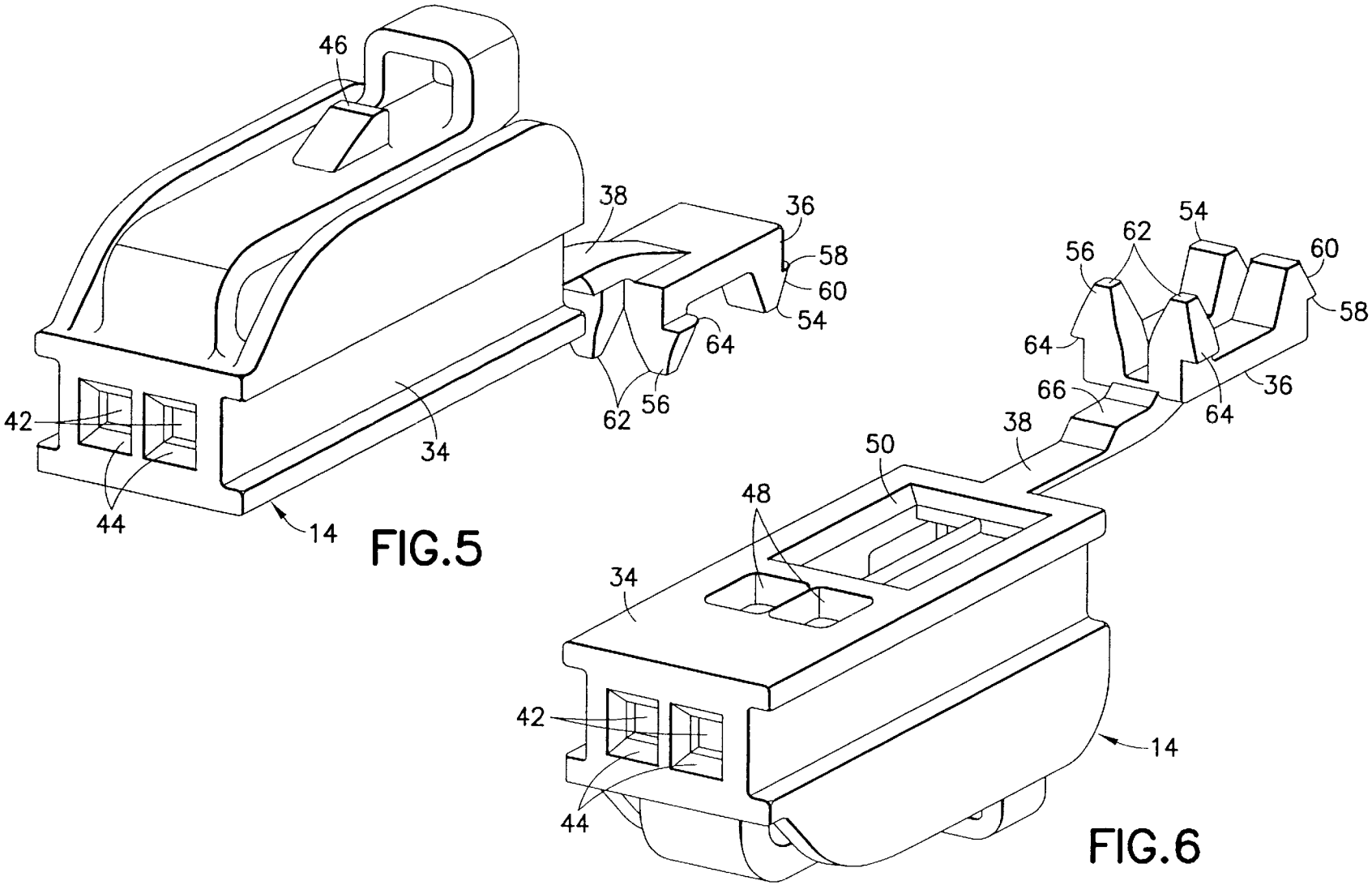
FIGS. 5 and 6 are perspective views of the electrical connector housing of the assembly shown in FIG. 3.
Figures 7, 8:
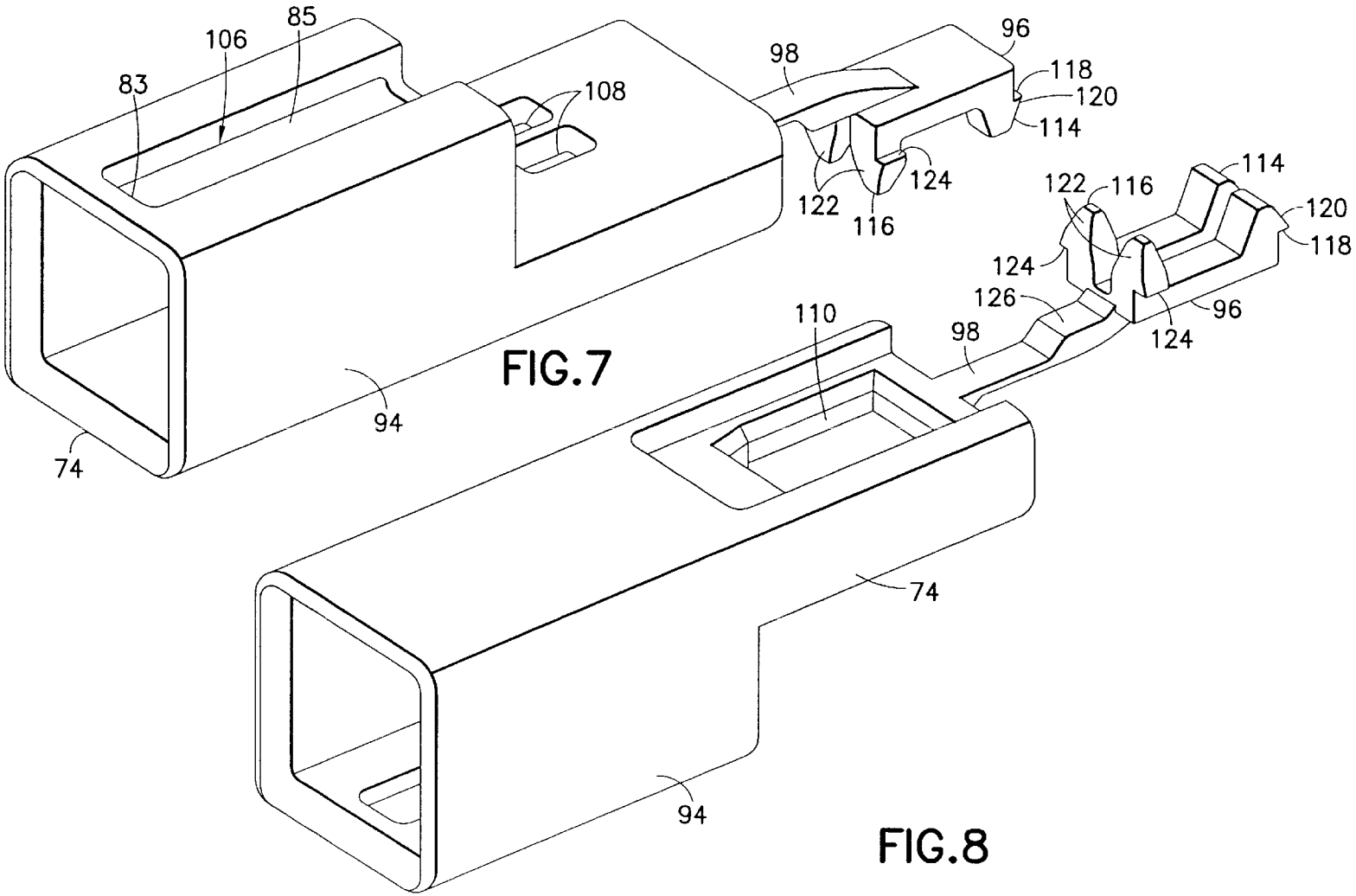
FIGS. 7 and 8 are perspective views of the electrical connector housing of the assembly shown in FIG. 4.

Referring also to FIGS. 5 and 6, the first housing 14 is preferably comprised of a one-piece molded plastic member. However, in alternate embodiments, the first connector housing 14 could be comprised of multiple components. The first housing 14 generally comprises a main body 34, a locking section 36 and a living hinge 38 which connects the locking section 36 to the main body 34.

The main body 34 generally comprises a receiving area 40 which is sized and shaped to receive the contacts 16 and a portion of the cable 18. The receiving area 40 comprises a front area with two contact receiving sections 42. The two contact receiving sections 42 comprises front end apertures 44 out of the main body 34. The top side of the main body 34 comprises a latching section 46 for latching with the second assembly 12 (see FIG. 1). The latching section 46 extends in a general cantilever fashion from the rest of the main body 34. Thus, the latching section 46 is resiliently deflectable to be able to snap lock mount with the second assembly 12. The rear end of the receiving area 40 is substantially open at the rear end of the main body 34.

The bottom side of the main body 34 comprises latch receiving apertures 48 and a locking section receiving aperture 50. The latch receiving apertures 48 are sized and shaped to receive the primary terminal latches 30 of the contacts 16. The rear surfaces 52 of the latch receiving apertures 48 form a stop surface for engaging the rear end latch surfaces 32 of the latches 30. Engagement between the stop surfaces 52 and the latch surfaces 32 form a primary contact latching system for preventing withdrawal of the contacts 16 out of the contact receiving sections 42. The locking section receiving aperture 50 is sized and shaped to allow insertion of the locking section 36 into the aperture 50.

The locking section 36 generally comprises a front end 54 and a rear end 56. The front end 54 comprises snap lock latching sections 58 and stop surfaces 60. When the locking section 36 is inserted into the receiving aperture 50, the snap lock latching sections 58 engage the main body 34 to latch the front end 54 to the main body. The stop surfaces 60 are positioned directly behind the stop surfaces 28 of the contacts 16. The location of the stop surfaces 60 directly behind the stop surfaces 28 form a secondary terminal lock to supplement the primary terminal lock provided by the latches 30.

The rear end 56 of the locking section 36 includes strain relief projections 62 and snap lock latching sections 64. The snap lock latching sections 64 extend in outward lateral directions. When the locking section 36 is inserted into the receiving aperture 50, the snap lock latching sections 64 engage the main body 34 to latch the rear end 56 to the main body. The strain relief projections 62 are sized and shaped to press or clamp the conductor cable 18 against the main body 34 in the rear end of the receiving area 40.

As described above, the locking section 36 is adapted to provide two functions. First, the locking section 36 can form a secondary terminal lock for the contacts 16 to prevent the contacts from being inadvertently removed out of the rear of the connector. Second, the locking section 36 can form a flat conductor cable strain relief for clamping the conductor cable 18 to the connector housing 14.

As noted above, the locking section 36 is connected to the main body 34 by a living hinge 38. The living hinge 38 retains the locking section to the main body 34 before the locking section is inserted into the aperture 50. This prevents the locking section 36 from being lost before the connector housing 14 is attached to the contacts 16 and cable 18. The living hinge 38 is bent as shown in FIG. 3 when the locking section 36 is inserted into the aperture 50. However, in alternate embodiments, any suitable type of connection of the locking section 36 to the main body 34 could be provided. The stepped surface section 66 can engage the bottom surface of the main body 34 to prevent the rear end of the locking section 36 from being inserted too far into the receiving area 40 and permanently crushing the conductor 18.

Referring now to FIGS. 1, 2, 4, 7 and 8, the second electrical connector and cable assembly 12 will be further described. The second electrical connector and cable assembly 12 generally comprises a connector housing 74, electrical contacts 76, and a conductor cable 78. The conductor cable 78 is a flex cable and generally comprises a flexible flat conductor cable or a flexible printed circuit cable. One end of the conductor cable 78 comprises the electrical contacts 76 individually connected thereto. More specifically, each electrical contact 76 is electrically connected to a respective one of the conductors 80, 81. The opposite end of the conductor cable 78 is attached to another component (not shown) such as an electrical or electronic component or another electrical connector.

The second assembly 12 comprises two of the electrical contacts 76. However, in alternate embodiments, the second assembly could comprise more or less than two electrical contacts. Each electrical contact 76 generally comprises a cable mounting section 82 and a mating contact section 84. The electrical contacts 76 are generally well known in the art. In alternate embodiments, any suitable type of electrical contact which is adapted to be mounted to a flat conductor cable could be provided.

The mating contact section 84 comprises a male contact section which is adapted to the inserted into the female contact section of one of the contacts 16. The cable mounting section 82 extends from one side of the mating contact section 84 in a reward direction. A rear end of the mating contact section 84 comprises a stop surface 88. The mating contact section 84 also comprises a primary terminal latch 90. The latch 90 is resiliently deflectable and comprises a rear end latch surface 92.

The cable mounting section 82 comprises two cable piercing sections 93. The piercing sections 93 are adapted to be inserted into and through the conductors 80 or 81 of the cable 78 and be outwardly deformed to form a fixed connection with the cable. This also forms an electrical connection between the contacts 76 and the conductors 80 or 81 in the cable 78. However, in alternate embodiments, any suitable type of connection between the contacts 76 and the cable 78 could be provided.

The second housing 74 is preferably comprised of a one piece molded plastic member. However, in alternate embodiments, the second connector housing 74 could be comprised of multiple components. The second housing 74 generally comprises a main body 94, a locking section 96 and a living hinge 98 which connects the locking section 96 to the main body 94.

The main body 94 generally comprises a rear receiving area 100 which is sized and shaped to receive the contacts 76 and a portion of the cable 78, and a front receiving area 101 which is sized and shaped to receive the front end of the first assembly 10. The rear receiving area 100 comprises a front area with two contact receiving sections 102. The top side of the main body 94 comprises a latching section 106 for latching with the first assembly 10 (see FIG. 1). The latching section 106 comprises a slot 85 and a latching surface 83. The rear end of the rear receiving area 100 is substantially open at the rear end of the main body 94.

The top side of the main body 94 comprises latch receiving apertures 108. The bottom side of the main body 94 comprises a locking section receiving aperture 110. The latch receiving apertures 108 are sized and shaped to receive the primary terminal latches 90 of the contacts 76. The rear surfaces 112 of the latch receiving apertures 108 form a stop surface for engaging the rear end latch surfaces 92 of the latches 90. Engagement between the stop surfaces 112 and the latch surfaces 92 form a primary contact latching system for preventing withdrawal of the contacts 76 out of the contact receiving sections 102. The locking section receiving aperture 110 is sized and shaped to allow insertion of the locking section 96 into the aperture 110.

The locking section 96 generally comprises a front end 114 and a rear end 116. The front end 114 comprises snap lock latching sections 118 and stop surfaces 120. When the locking section 96 is inserted into the receiving aperture 110, the snap lock latching sections 118 engage the main body 94 to latch the front end 114 to the main body. The stop surfaces 120 are positioned directly behind the stop surfaces 88 of the contacts 76. The location of the stop surfaces 120 directly behind the stop surfaces 88 form a secondary terminal lock to supplement the primary terminal lock provided by the latches 90.

The rear end 116 of the locking section 96 includes strain relief projections 122 and snap lock latching sections 124. The snap lock latching sections 124 extend in outward lateral directions. When the locking section 96 is inserted into the receiving aperture 110, the snap lock latching sections 124 engage the main body 94 to latch the rear end 116 to the main body. The strain relief projections 122 are sized and shaped to press or clamp the conductor cable 78 against the main body 94 in the rear end of the receiving area 100.

As described above, the locking section 96 is adapted to provide two functions. First, the locking section 96 can form a secondary terminal lock for the contacts 76 to prevent the contacts from being inadvertently removed out of the rear of the connector. Second, the locking section 96 can form a flat conductor cable strain relief for clamping the conductor cable 78 to the connector housing 74.

Figure 4:
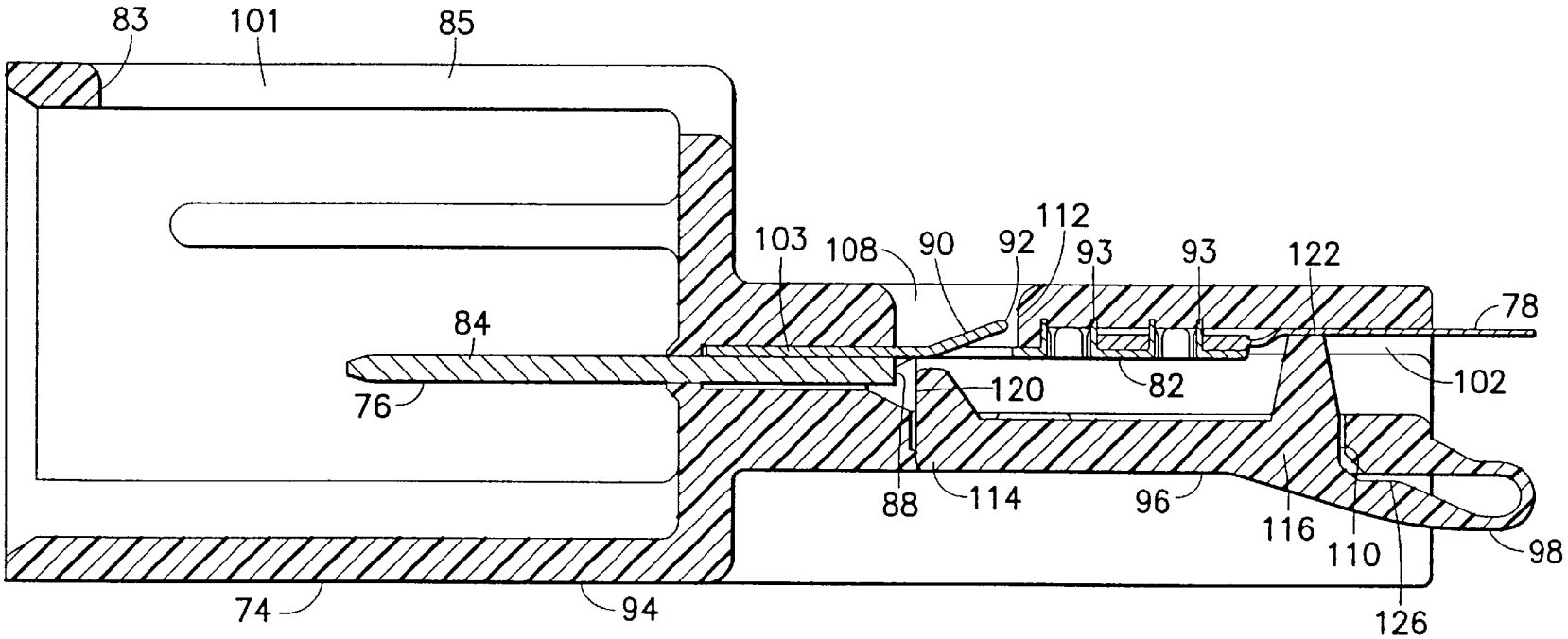
FIG. 4 is a cross sectional view of a second one of the electrical connector and cable assemblies shown in FIG. 1.

As noted above, the locking section 96 is connected to the main body 94 by a living hinge 98. The living hinge 98 retains the locking section to the main body 94 before the locking section is inserted into the aperture 110. This prevents the locking section 96 from being lost before the connector housing 74 is attached to the contacts 76 and cable 78. The living hinge 98 is bent as shown in FIG. 4 when the locking section 96 is inserted into the aperture 110. However, in alternate embodiments, any suitable type of connection of the locking section 96 to the main body 94 could be provided. The stepped surface section 126 can engage the bottom surface of the main body 94 to prevent the rear end of the locking section 96 from being inserted too far into the receiving area 100 and permanently crushing the conductor 78.

Figures 9, 10:
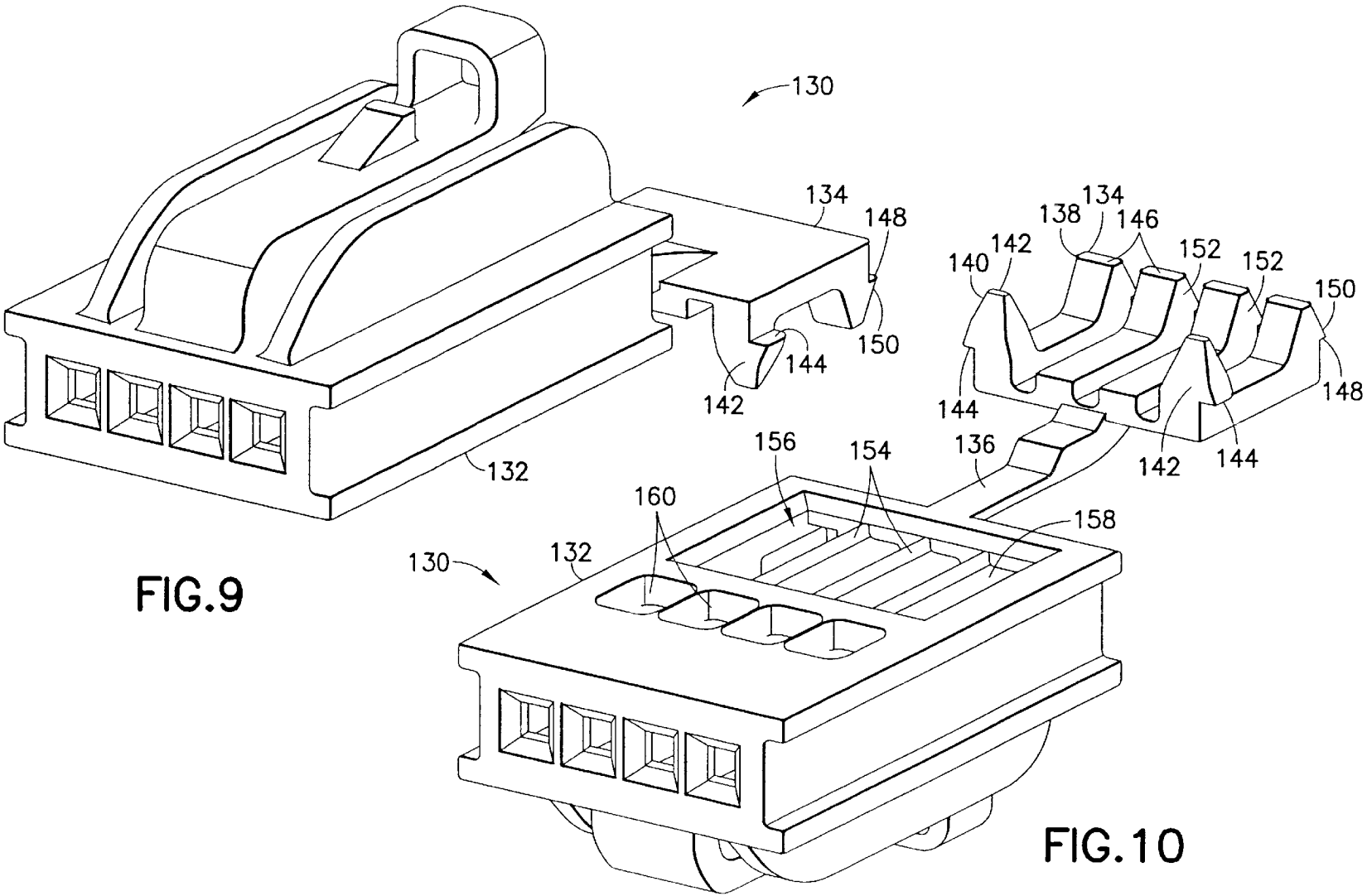
FIGS. 9 and 10 are perspective views of an alternate embodiment of the electrical connector housing shown in FIGS. 5 and 6.

Referring now also to FIGS. 9 and 10, a connector housing 130 for an alternate embodiment of the assembly 10 shown in FIG. 1 is shown. In this embodiment the connector housing 130 is adapted to be used with four of the electrical contacts 16 and a flat conductor cable having four conductors. The connector housing 130 generally comprises a main body 132, a locking section 134, and a living hinge 136. The living hinge 136 connects the locking section 134 to the main body 132. The locking section 134 comprises a front end 138 and the rear end 140. The rear end 140 comprises two strain relief projections 142. The strain relief projections 142 also comprises snap lock latching sections 144. The front end 138 comprises four projections 146. Each projection 146 comprises a snap lock latching section 148 and a stop surface 150. Grooves 152 are provided between the projections 146 to accommodate separator portions 154 in the main body 132.

Similar to the connector housing 14 shown in FIGS. 5 and 6, the connector housing 130 comprises a locking section receiving aperture 156 which is adapted to receive the locking section 134. The locking section 134 can be inserted into the aperture 156 and snap lock mounted to the main body 132. The strain relief projections 142 can clamp lateral edges of the flat flex conductor cable against the main body 132 in the rear receiving area 158. The stop surfaces 150 can form a barrier to the withdrawal of the contacts 16. The connector housing 130 also comprises latch receiving apertures 160 in the main body 132 for receiving the primary terminal latches 30 of the electrical contacts 16.

Figures 11, 12:
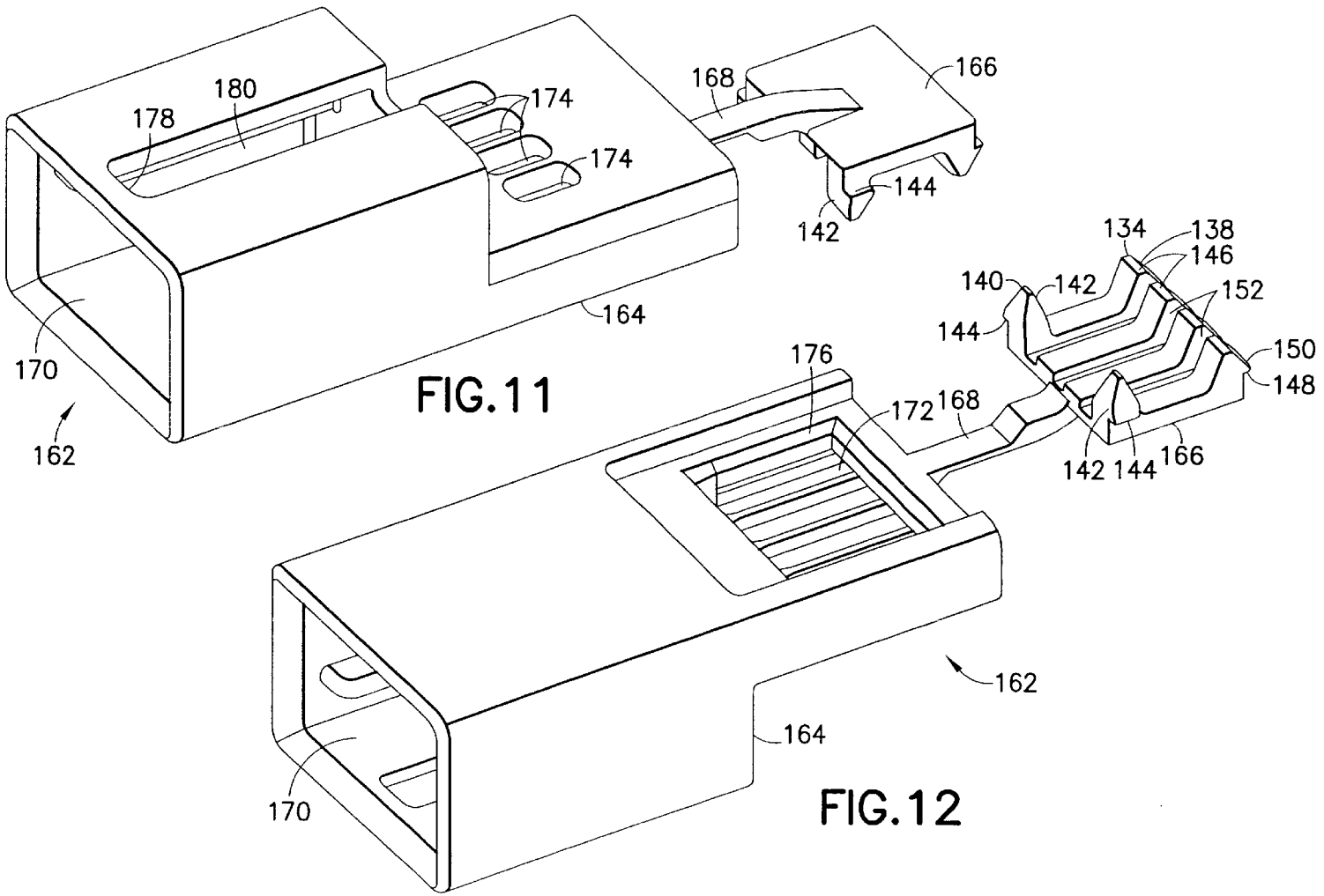
FIGS. 11 and 12 are perspective views of an alternate embodiment of the electrical connector housing shown in FIGS. 7 and 8.

Referring now also to FIGS. 11 and 12, a connector housing 162 for an alternate embodiment of the assembly 12 shown in FIG. 1 is shown. The connector housing 162 is adapted to receive four of the electrical contacts 76 and a flex cable having four conductors. The connector housing 162 generally comprises a main body 164, a locking section 166 and a living hinge 168. The main body 164 comprises a front receiving area 170, a rear receiving area 172, latch receiving areas 174, and a locking section receiving aperture 176. The main body 164 also comprises a latching surface 178 and a slot 180. The latching surface 178 and slot 180 function in the same manner as the slot 85 and surface 83 described with reference to FIGS. 7 and 8.

The front receiving area 170 is sized and shaped to receive the connector housing 130, shown in FIGS. 9 and 10, therein. The latch receiving areas 174 are adapted to receive the latches 90 of the contacts 76. The locking section 166 is substantially identical to the locking section 138 shown in FIGS. 9 and 10. Thus, like numbers are used in FIGS. 11 and 12 corresponding to the features of the locking section shown in FIGS. 9 and 10. The locking section 166 can be snap lock inserted into the locking section receiving aperture 176. The strain relief projections 142 can clamp lateral edges of the conductor cable against the main body 164 in the rear receiving area 172. The stop surfaces 152 can form a barrier to the withdrawal of the contacts 76.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector housing comprising:

a main body having a receiving area which is sized and shaped to receive a flat conductor cable with contacts attached thereto into the receiving area; and a locking section connected to the main body by a living hinge, the locking section comprising a front end and a rear end, wherein when the locking section is inserted into a receiving aperture of the main body the front end is adapted to block withdrawal of at least one of the contacts located in the receiving area and, the rear end includes at least one strain relief projection which is sized and shaped to press the flat conductor cable against the main body to form a strain relief for the cable.

2. An electrical connector housing as in claim 1 wherein the main body, the locking section, and the living hinge are comprised of a one-piece molded plastic member.

3. An electrical connector housing as in claim 1 wherein the main body comprises latch receiving apertures adapted to receive primary terminal latches of the contacts.

4. An electrical connector housing as in claim 1 wherein the living hinge extends from a rear end of the main body.

5. An electrical connector housing as in claim 1 wherein the front end of the locking section comprises a snap lock latching section.

6. An electrical connector housing as in claim 5 wherein the rear end of the locking section comprises a snap lock latching section.

7. An electrical connector assembly comprising:

an electrical connector housing as in claim 1;

a flat conductor cable; and electrical contacts attached to the cable;

wherein the contacts and a portion of the cable are located in the housing, wherein the locking section is inserted into a receiving aperture in the main body with the front end of the locking section blocking withdrawal of the contacts from the housing and the rear end of the locking section clamping the flat conductor cable against the main body to form a strain relief for the cable.

8. An electrical connector assembly as in claim 7 wherein the contacts comprise post loaded contacts which pierce through the cable.

9. An electrical connector assembly comprising:

a flat conductor cable;

electrical contacts attached to the cable; and a housing having the contacts and a portion of the cable located therein, the housing comprising a main body, a locking section and a living hinge connecting the locking section to the main body, wherein the locking section is insertable into a receiving aperture in the main body with a front end of the locking section blocking withdrawal of the contacts from the housing and a rear end of the locking section clamping the flat conductor cable against the main body to form a strain relief for the cable.

10. An electrical connector assembly as in claim 9 wherein the contacts comprise post loaded contacts which pierce through the cable.

11. An electrical connector assembly as in claim 9 wherein the main body, the locking section, and the living hinge are comprised of a one-piece molded plastic member.

12. An electrical connector assembly as in claim 9 wherein the main body comprises latch receiving apertures adapted to receive primary terminal latches of the contacts.

13. An electrical connector assembly as in claim 9 wherein the living hinge extends from a rear end of the main body.

14. An electrical connector assembly as in claim 9 wherein the front end of the locking section comprises a snap lock latching section.

15. An electrical connector assembly as in claim 14 wherein the rear end of the locking section comprises a snap lock latching section.

16. A method of assembling an electrical connector comprising steps of:

connecting electrical contacts to a flat conductor cable;

inserting the contacts and a portion of the flat conductor cable into a main section of a connector housing;

inserting a locking section of the connector housing into a receiving aperture of the main section, the connector housing comprising a living hinge which connects the locking section to the main section, wherein the step of inserting the locking section comprises bending the living hinge, wherein the locking section blocks withdrawal of the contacts from the housing; and clamping a portion of the flat conductor cable against the main section and the locking section when the locking section is inserted into the connector housing to form a strain relief for the flat conductor cable.

17. A method as in claim 16 wherein the step of connecting the electrical contacts to the flat conductor cable comprises piercing portions of the contacts through the flat conductor cable.

* * * * *